US008452202B2

(12) United States Patent
Mochizuki

(10) Patent No.: US 8,452,202 B2
(45) Date of Patent: May 28, 2013

(54) HEATING DEVICE AND IMAGE FORMING APPARATUS WITH FIXING DEVICE SWITCHED ON/OFF IN RESPONSE TO A ZERO-CROSS POINT OF AN AC VOLTAGE OUTPUT FROM AN AC POWER SOURCE

(75) Inventor: Masayuki Mochizuki, Osaka (JP)

(73) Assignee: Kyocera Mita Corporation (JP)

( * ) Notice: Subject to any disclaimer, the term of this patent is extended or adjusted under 35 U.S.C. 154(b) by 480 days.

(21) Appl. No.: 12/392,807

(22) Filed: Feb. 25, 2009

(65) Prior Publication Data

US 2009/0214246 A1 Aug. 27, 2009

(30) Foreign Application Priority Data

Feb. 26, 2008 (JP) ..... 2008-043802

(51) Int. Cl.
*G03G 15/00* (2006.01)
*G03G 15/20* (2006.01)

(52) U.S. Cl.
USPC ..... 399/88; 399/67

(58) Field of Classification Search
USPC ..... 399/67, 69, 88; 219/216; 323/319
See application file for complete search history.

(56) References Cited

U.S. PATENT DOCUMENTS

| | | | | |
|---|---|---|---|---|
| 4,603,245 | A * | 7/1986 | Yagasaki | 219/216 |
| 2004/0022550 | A1 * | 2/2004 | Okada | 399/67 |

FOREIGN PATENT DOCUMENTS

| | | | |
|---|---|---|---|
| JP | 61-075409 | | 4/1986 |
| JP | 61-235917 | | 10/1986 |
| JP | 4-165954 | | 6/1992 |
| JP | 06110141 | A * | 4/1994 |
| JP | 10-123632 | | 5/1998 |
| JP | 10123632 | A * | 5/1998 |
| JP | 2002-272089 | | 9/2002 |
| JP | 2004157659 | | 6/2004 |
| JP | 2004177579 | A * | 6/2004 |
| JP | 2005-19295 | | 1/2005 |
| JP | 2005056597 | A * | 3/2005 |
| JP | 2008-10319 | | 1/2008 |

* cited by examiner

*Primary Examiner* — Walter L Lindsay, Jr.
*Assistant Examiner* — Milton Gonzalez
(74) *Attorney, Agent, or Firm* — Gerald E. Hespos; Michael J. Porco; Matthew T. Hespos

(57) ABSTRACT

A controller outputs a heater control signal in synchronization with a rise in a zero-cross signal. In response to the heater control signal, a switching device of a heater driving circuit switches ON/OFF. However, a noise occurs in an output voltage of an AC power source at the time of switching, and this noise causes a false zero-cross signal. For the purpose of preventing operation of a heater in accordance with the false zero-cross signal, the controller disregards the rise in the zero-cross signal during a set time period after the rise in the heater control signal.

8 Claims, 6 Drawing Sheets

HEATING DEVICE AND IMAGE FORMING APPARATUS WITH FIXING DEVICE SWITCHED ON/OFF IN RESPONSE TO A ZERO-CROSS POINT OF AN AC VOLTAGE OUTPUT FROM AN AC POWER SOURCE

BACKGROUND OF THE INVENTION

1. Field of the Invention

The present invention relates to a heating device and an image forming apparatus, in which a heater provided in a fixing device is switched ON/OFF in response to a zero-cross point of an AC voltage outputted from an AC power source.

2. Description of the Related Art

An image forming apparatus such as a printer, a copying machine, a facsimile machine, and a complex machine having functions of those has a fixing device which applies a fixing processing to a toner image formed on a sheet. The fixing device generally has a heating roller and a pressing roller, and a sheet passes through a nip portion between the rollers, so that a toner image is fixed on the sheet.

In such heating roller of a fixing device, there is provided a heater, and a power supply from the AC power source to the heater is controlled by a switching device. In other words, the power supply to the heater is switched ON/OFF by the switching device, so that the temperature of the heater is controlled. Further, it is known that a switching noise occurs when the switching device switches ON/OFF. To avoid an effect of the switching noise, the switching device is controlled to switch ON/OFF at a timing (zero-cross point) at which an output of the AC power source becomes zero.

However, when a switching control is performed with respect to such a great load of a heater of a heating roller, the output of the AC power source is changed by a noise. The change in the AC power source causes a zero-cross point to be detected falsely, so that the heater control has been interfered.

In view of such phenomenon, Japanese Patent No. 3636254 discloses a technology related to a fixing device using a phase control to control the temperature of a heater. According to this technology, a zero-cross interruption timing and a switching timing are controlled to be in one-to-one relationship, and a zero-cross interruption due to a noise is disregarded even if the zero-cross interruption falls between the zero-cross interruption timing and the switching timing. Further, Japanese Unexamined Patent Publication No. 2002-272089, Japanese Examined Patent Application Publication No. 5-87844, Japanese Examined Patent Application Publication No. 7-72849, and Japanese Unexamined Patent Publication No. 4-165954 disclose a technology of providing a zero-cross interruption disregard period, taking the zero-cross interruption as a trigger, to perform a control of disregarding a zero-cross interruption due to a noise.

SUMMARY OF THE INVENTION

The present invention was made by further improving the conventional technology, and it can prevent a malfunction by reliably disregarding a zero-cross interruption which occurs due to a noise.

In summary, according to an aspect of the present invention, a heating device includes: a heater which is driven by a power supplied from an AC power source; a switching portion which switches ON/OFF of the power supplied from the AC power source to the heater; a zero-cross signal output portion which outputs a zero-cross signal in response to a zero-cross point of an AC voltage outputted from the AC power source; and a controller which controls the switching portion to switch ON/OFF in response to the zero-cross signal, and the controller disregards the zero-cross signal outputted within a predetermined time period after controlling the switching portion to switch ON/OFF and prevents the switching portion from switching ON/OFF in response to the zero-cross signal.

These and other objects, features and advantages of the present invention will become more apparent upon reading of the following detailed description along with the accompanied drawings.

DETAILED DESCRIPTION OF THE PREFERRED EMBODIMENTS

A heating device and an image forming apparatus in accordance with an embodiment of the present invention will be described with reference to the drawings. In the present embodiment, a copying machine is described as an example of an image forming apparatus in accordance with the present invention, and a heating device provided in the copying machine is described as a heating device in accordance with the present invention. Other than the above, the image forming apparatus may be a scanner, a facsimile machine, and the like or a complex machine having functions of those, as long as the image forming apparatus is provided with a fixing device which heats a toner image formed on a sheet to fix the toner image and adopts an electrophotographic method.

Figure 1:
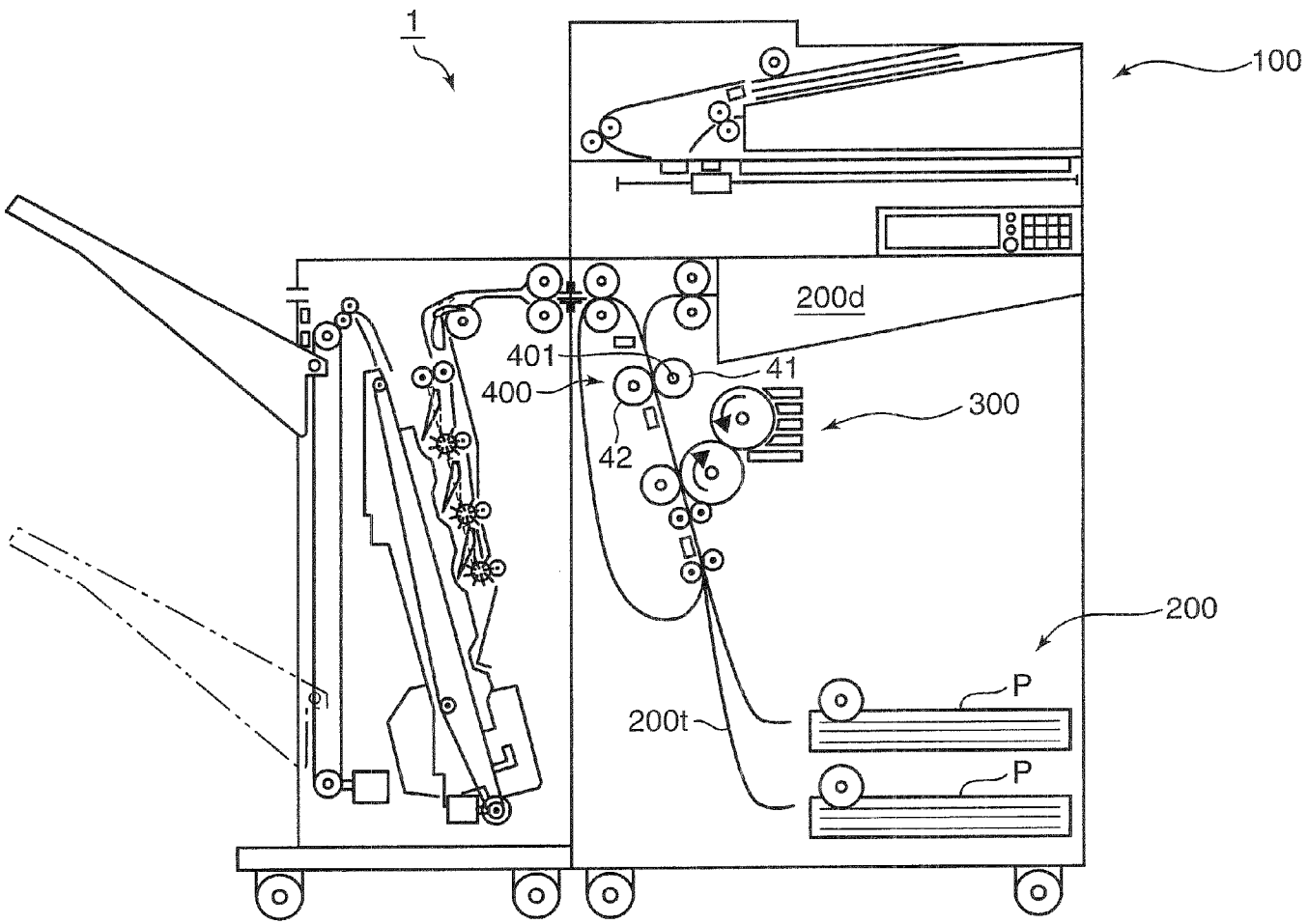
FIG. 1 is a sectional view schematically showing a copying machine.

FIG. 1 is a sectional view schematically showing a copying machine 1. The copying machine 1 includes an image reading section 100 which reads an image of a document, a sheet-feeding section 200 which stores and feeds a sheet P, a conveying passage 200*t* which extends from the sheet-feeding section 200 to convey the sheet P, an image forming section 300 which is provided on the conveying passage 200*t* and forms a toner image onto the conveyed sheet P in accordance with an image read by the image reading section 100, a fixing device 400 which applies a fixing processing with respect to the sheet P on which a toner image is formed by the image forming section 300, and a sheet discharging section 200*d* which discharges the sheet P to which the fixing processing is applied by the fixing device 400.

The image forming section 300 irradiates a light in accordance with an image read by the image reading section 100 to a charged photoconductive drum to form an electrostatic latent image onto the photoconductive drum. Toner is supplied from the developing device to the photoconductive drum so that a toner image appears, and the toner image is transferred to the sheet P so that the toner image is formed on the sheet P.

The fixing device 400 includes a heating roller 41 and a pressing roller 42. the sheet P passes through a nip portion between the heating roller 41 and the pressing roller 42, so that a heating/pressing processing is applied to fix the toner image on the sheet P. Further, the heating roller 41 is provided with a heater 401 which receives a power supply from an AC power source to generate heat.

Figure 2:
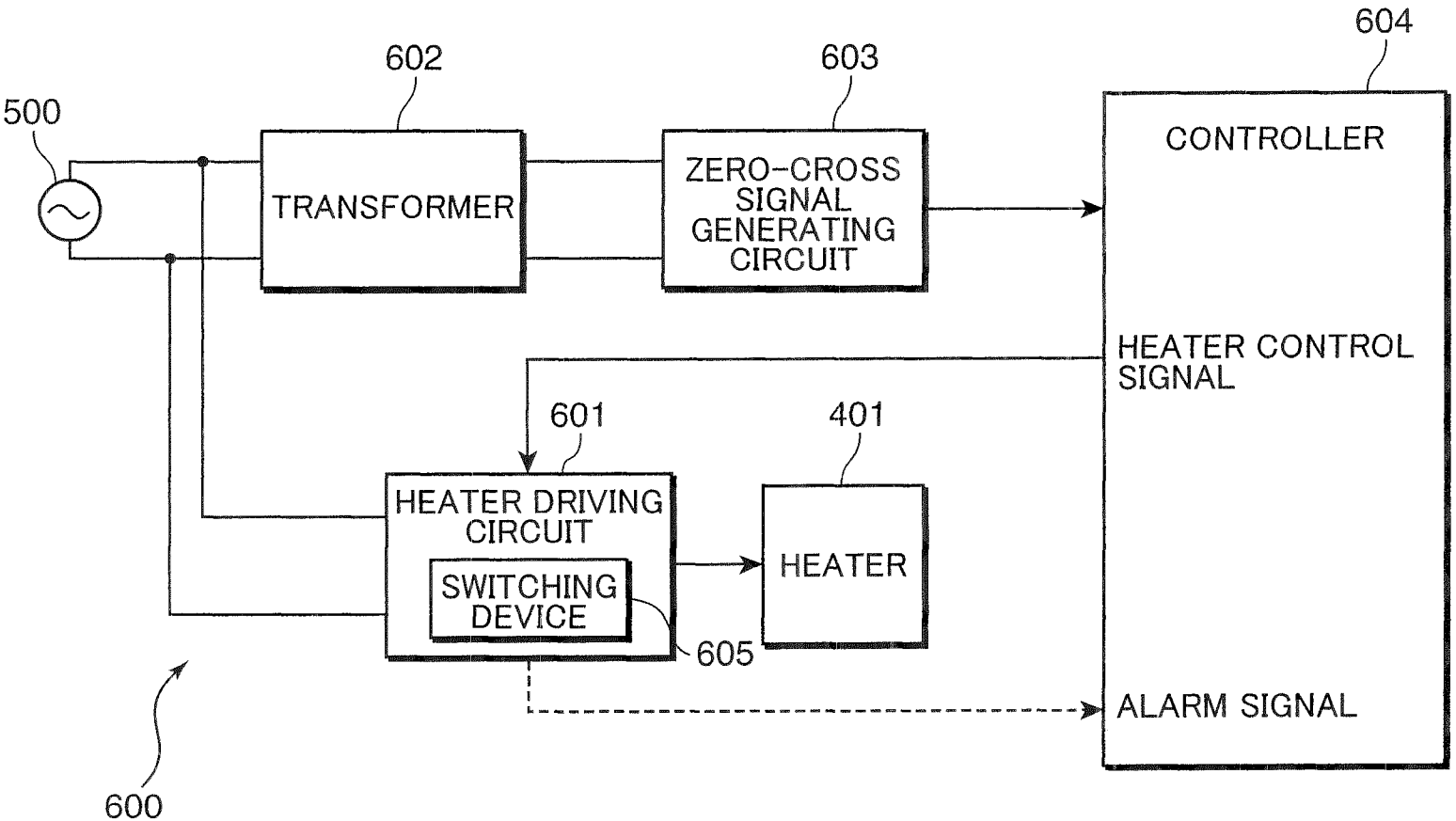
FIG. 2 is a block diagram showing an electric configuration of a heating device.

FIG. 2 is a block diagram showing a configuration of a heating device 600 having the heater 401. The heating device 600 includes a heater 401, an AC power source 500, a heater driving circuit 601, a transformer 602, a zero-cross signal generating circuit 603, and a controller 604.

The AC power source 500 inputs a power from a commercial power source through an outlet or the like to supply a power to respective functional portions of the copying machine 1. The heater driving circuit 601 receives an AC power supplied from the AC power source 500 to drive the heater 401. The heater driving circuit 601 includes a switching device 605, and the switching device 605 switches ON/OFF in accordance with a heater control signal (a control signal in claim) outputted from the controller 604. Switching of ON/OFF by the switching device 605 causes a power supply from the AC power source 500 to the heater 401 to be switched between a supplying state and a supply idling state.

The transformer 602 steps down the output voltage of the AC power source 500 and outputs the voltage to the zero-cross signal generating circuit 603. The zero-cross signal generating circuit 603 detects passing of 0[V] in the output signal outputted from the transformer 602 and outputs a zero-cross signal in response to the passing of 0[V].

The controller 604 is configured by a CPU (Central Processing Unit) or the like and reads a stored program in accordance with an inputted instruction signal and executes a processing, outputs an instruction signal to respective functional portions, and transfers data, so that the copying machine 1 is integrally controlled. Especially in the heating device 600, the controller 604 outputs a heater control signal to the heater driving circuit 601 in response to a zero-cross signal outputted from the zero-cross signal generating circuit 603. In accordance with the heater control signal, the switching device 605 of the heater driving circuit 601 is switched ON/OFF, so that the heater 401 is switched ON/OFF.

Figure 3:
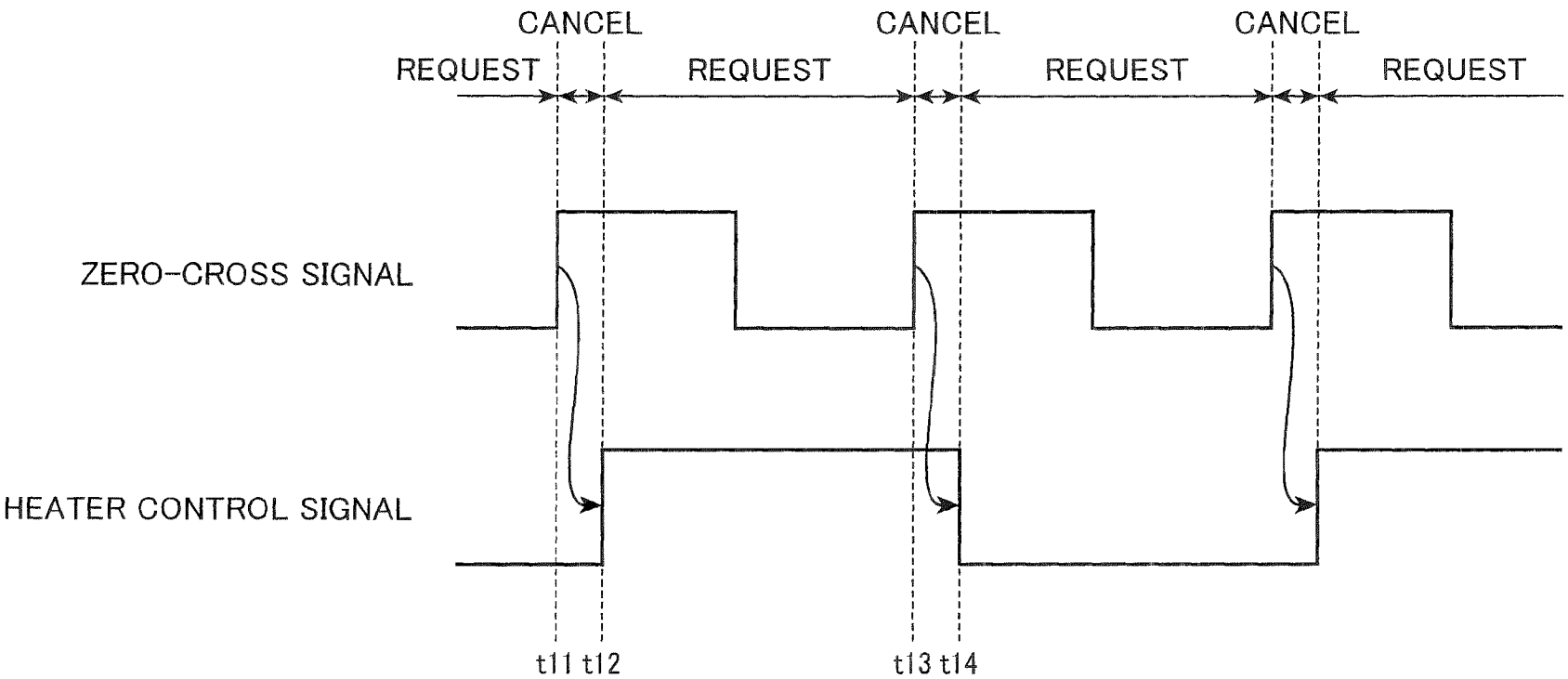
FIG. 3 is a timing chart showing a zero-cross signal and a heater control signal in a state where a noise due to switching does not occur with respect to an output of the AC power source.

FIG. 3 is a timing chart showing a zero-cross signal and a heater controls signal in a state where a noise due to switching does not occur with respect to an output of the AC power source (under a normal operation). When the heater control signal is at a high level, a power is supplied to the heater 401 by the heater driving circuit 601, and the heater 401 is in an ON state (heat-generating state). When the heater control signal is at a low level, the heater 401 is in an OFF state.

In an initial state, the controller 604 is in a zero-cross interruption request state, in other words, a state where the controller 604 accepts execution of an interruption processing in accordance with an input of a zero-cross signal. In synchronization with a rise in the zero-cross signal at a time t11, specifically, taking a rise in the zero-cross signal as a trigger, the controller 604 once cancels the zero-cross interruption request for a predetermined time period. In other words, the controller 604 disregards (prohibit) an input of the zero-cross signal for a period between the input of the zero-cross signal and a termination of an execution of the interruption processing.

In synchronization with the rise in the zero-cross signal, the controller 604 once cancels the zero-cross interruption request and also outputs a heater control signal to the heater driving circuit 601 (time t12). This causes the heater 401 to be in the ON state. The controller 604, in synchronization with the output of the heater control signal, is shifted to the zero-cross interruption request state again. Then, in synchronization with a rise in the zero-cross signal at a time t13, the controller 604 once cancels the zero-cross interruption request and also outputs a heater control signal to the heater driving circuit 601 (time t14). This causes the heater 401 to be shifted to the OFF state. As described above, the controller 604 outputs the heater control signal in synchronization with the rise in the zero-cross signal, and the heater driving circuit 601 accepts the heater control signal to switch ON/OFF the heater 401.

Figure 4:
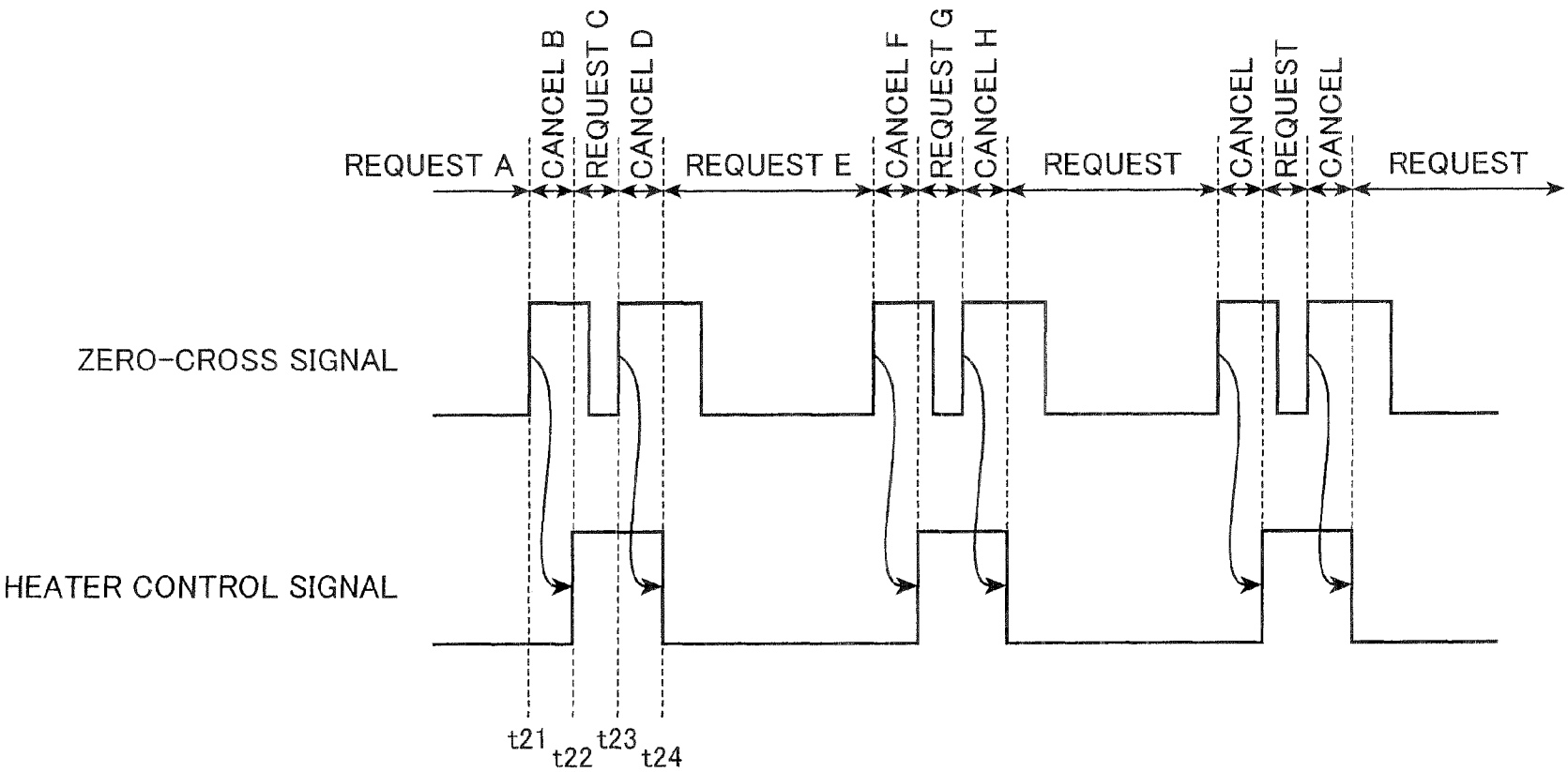
FIG. 4 is a timing chart showing a zero-cross signal and a heater control signal in a state where a noise due to switching occurs with respect to an output of the AC power source.

FIG. 4 is a timing chart showing a zero-cross signal and a heater control signal in a state where a noise due to switching occurs with respect to an output of the AC power source. Similarly to FIG. 3, in an initial state, the controller 604 is in a zero-cross interruption request state (request A shown in FIG. 4). Then, in synchronization with a rise in the zero-cross signal at a time t21, the controller 604 once cancels the zero-cross interruption request (cancel B shown in FIG. 4) and also outputs a heater control signal to the heater driving circuit 601 (time t22). This causes the heater 401 to be shifted to the ON state. The controller 604, in synchronization with the output of the heater control signal, is shifted to the zero-cross interruption request state (request C) again.

However, if a noise occurs in the output voltage of the AC power source 500 at a time when the switching device 605 of the heater driving circuit 601 switches the heater 401 from OFF to ON, there is a case where the zero-cross signal generating circuit 603 falsely detects the noise as the zero-cross point. For example, if a noise occurs in the output voltage of the AC power source 500 at a timing where the heater 401 is shifted to the ON state at the time t22 so that the zero-cross signal once falls down to the low level, and the zero-cross signal rises (time t23) when the controller 604 is in the zero-cross interruption request state (request C), the controller 604, in synchronization with the rise in the zero-cross signal, once cancels the zero-cross interruption request (cancel D) and outputs the heater control signal to the heater driving circuit 601 (time t24). Accordingly, the heater 401 is shifted to the OFF state.

Figure 5A:
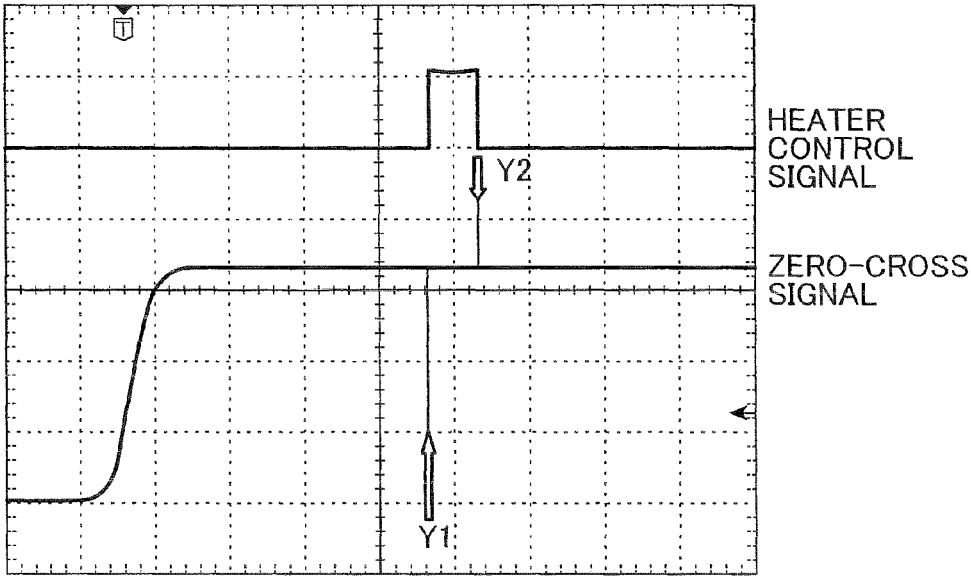
FIG. 5A shows actual measurement of a zero-cross signal and a heater control signal.
Figure 5B:
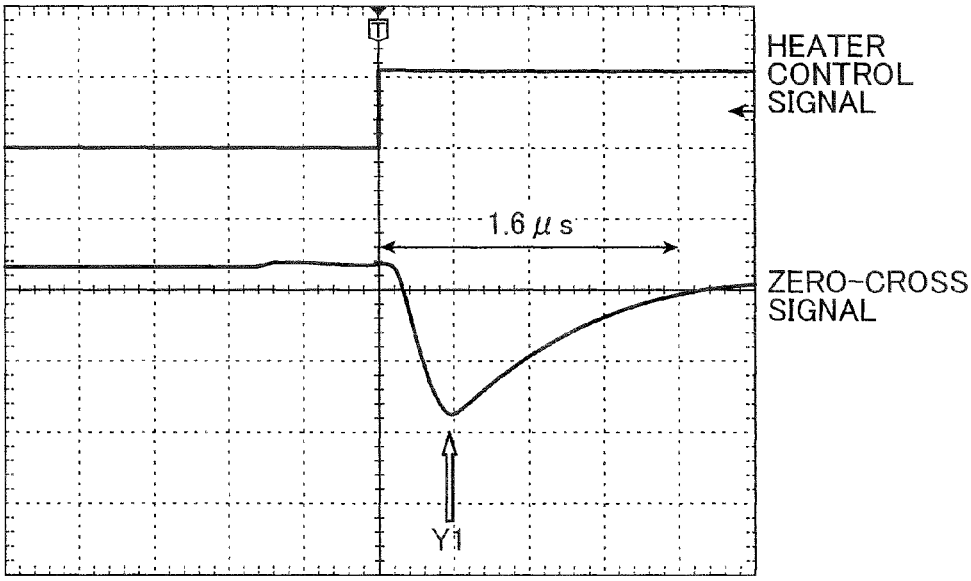
FIG. 5B is a graph enlarging a noise indicated by the arrow Y1 in FIG 5A.

Graphs of actual measurement are shown in FIG. 5. FIG. 5A shows actual measurement of a zero-cross signal and a heater control signal. In FIG. 5A, the heater control signal rises in synchronization with a rise in the zero-cross signal, so that the heater 401 is shifted to the ON state. Here, a noise indicated by an arrow Y1 occurs when the heater 401 is switched from ON to OFF. FIG. 5B is a graph enlarging the noise indicated by the arrow Y1. The zero-cross signal fell down due to the noise immediately after the heater control signal, and then rose within 1.6 [μs]. The controller 604 accepts this rise and recognizes that the zero-cross interruption occurs. Then, the controller 604 executes a processing of switching the heater control signal from ON to OFF. With respect to the noise indicated by an arrow Y2 occurred thereafter, since a noise level is low, the controller 604 did not recognize as occurrence of the zero-cross interruption and did not execute the interruption processing.

In a case where the power supply frequency is 50 [kHz], the zero-cross signal is generated in an interval of 10 [ms]. Therefore, the heater 401 remains in the ON state for 10 [ms] at the longest. However, when the zero-cross signal is generated due to the noise as shown in FIG. 4, the heater 401 remained in the ON state just for 160 [μs]. As described above, in the case where a noise occurs and the zero-cross point is falsely detected, the heating time of the heater 401 becomes shorter as compared to the case where the heater 401 is operated in a normal manner. Accordingly, the temperature of the heating roller 41 does not rise, and a defect in fixing may occur. On the contrary, if the heating time of the heater 401 becomes longer than the case where the heater 401 is operated in a normal manner, disadvantages such as an increase in a consumed power and an early deterioration of the heater 401 may occur.

Therefore, in the present embodiment, a method for reliably disregarding the zero-cross signal outputted due to a noise is proposed, by which the state of cancelling the zero-cross interruption request by the controller 604 is not set to be a predetermined time period after being triggered by the input of the zero-cross signal, but the state of cancelling the zero-cross interruption request is set to be for a period (hereinafter, referred to as "set time period T") from the execution of the interruption processing (output of the heater control signal, or switching of ON/OFF of the switching device 605) based on the input of the zero-cross signal, so that the zero-cross signal outputted due to the noise can be reliably disregarded.

Figure 6:
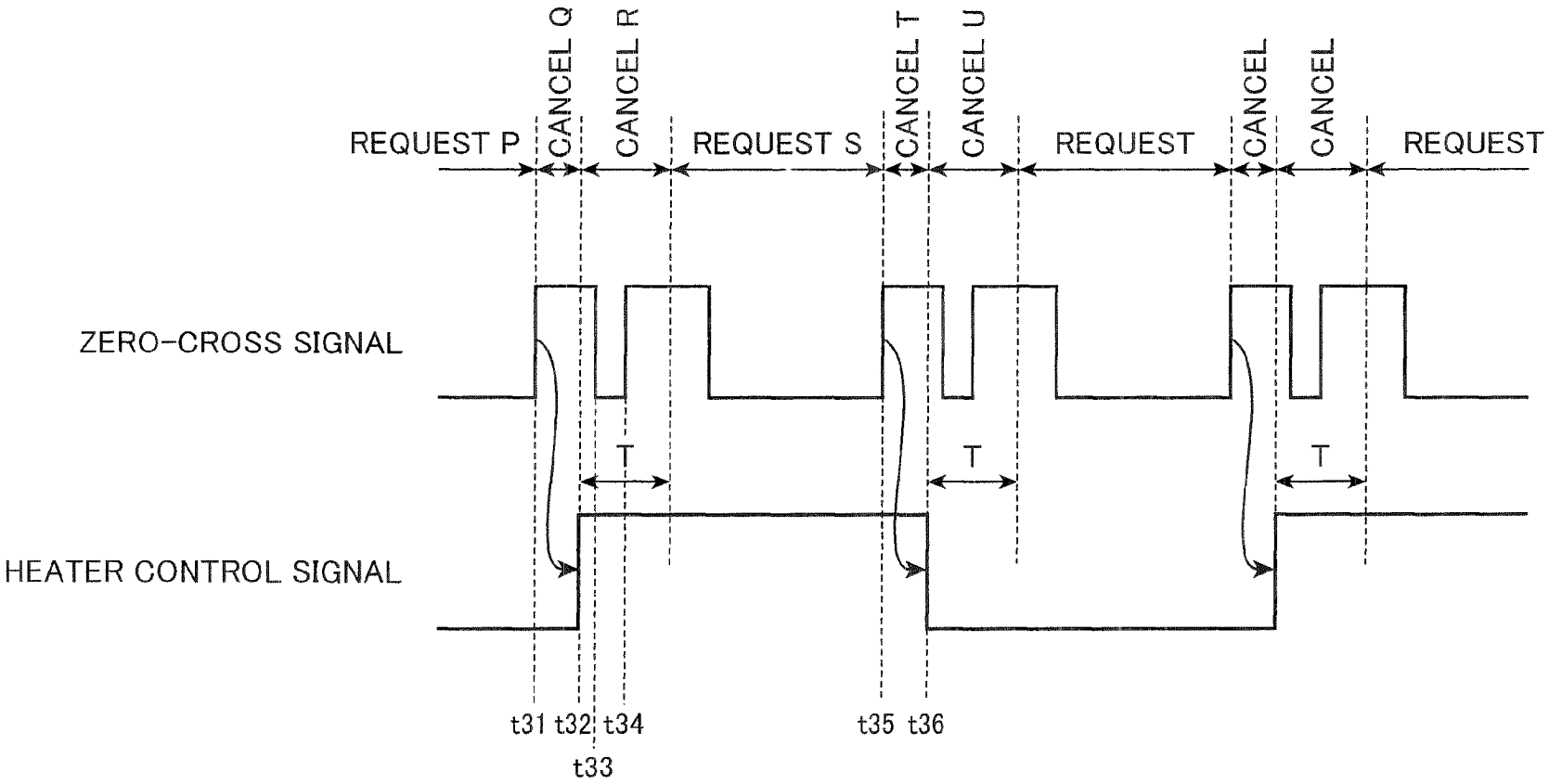
FIG. 6 is a timing chart showing a zero-cross signal and a heater control signal in a heating device of a copying machine in accordance with an embodiment.

Details will be described with reference to FIG. 6. FIG. 6 is a timing chart showing a zero-cross signal and a heater control signal in the heating device 600 of the copying machine 1 in accordance with the present embodiment. Similarly to FIG. 3, in an initial state, the controller 604 is in the zero-cross interruption request state (request P shown in FIG. 6). Then, in synchronization with the rise in the zero-cross signal at the time t31, the controller 604 once cancels the zero-cross interruption request (cancel Q shown in FIG. 6) and outputs the heater control signal to the heater driving circuit 601 (time t32). This causes the heater 401 to be shifted to the ON state. Similarly to the period of cancel B shown in FIG. 4, the cancel Q is a cancel period which is designed in the controller 604 to accept no interruption signal during the execution of the interruption processing.

In a conventional manner, the period of the cancel Q is terminated in synchronization with the output of the heater control signal, and then the state is shifted to the zero-cross signal request state. However, the controller 604 maintains the zero-cross interruption request cancel state (cancel R) also during the set time T after the output of the heater control signal. In other words, since ON/OFF of the switching device 605 of the heater driving circuit 601 is switched by the output of the heater control signal, there is likelihood that a noise occurs in the output voltage of the AC power source 500. For the purpose of disregarding the false output of the zero-cross signal due to the noise, the controller 604 disregards an input of the zero-cross signal for the set time period T from the output of the heater control signal.

Then, a noise occurs in the output voltage of the AC power source 500 at the timing when the heater 401 is switched from OFF to ON, and the zero-cross signal once falls down to a low level at the time t33, and then the zero-cross signal rises at the time t34 again. However, since the controller 604 is in the zero-cross interruption request cancel state (cancel R), it does not accept the rise in the zero-cross signal. Thus, since the controller 604 does not perform switching of the heater control signal in synchronization with the rise in the zero-cross signal at the time t34, the heater 401 remains in the ON state. Then, after an elapse of the set time period T, the controller 604 is shifted to the zero-cross interruption request state (request S) again, the heater 401 is shifted to the OFF state in synchronization with the rise in the zero-cross signal at the next time t35.

A method for setting the set time period T can be determined in accordance with a timing at which a zero-cross signal due to a noise occurs from the rise in the heater control signal. For example, in accordance with the graph of FIG. 5 showing the actual measurement, the zero-cross signal is rises due to the noise after 1.6 [μs] from the rise in the heater control signal. Accordingly, to disregard the rise, the set time period T is set to be about 2.0 [μs].

As described above, by determining a zero-cross interruption request cancel period with an output timing of the heater control signal as a trigger, regardless of whether or not the drive control of the heater is a phase control, a zero-cross signal which occurs due to a noise which occurs due to switching of ON/OFF of the switching device 605 in response to the heater control signal can be reliably disregarded, so that a malfunction in the heater 401 can be prevented.

In the present embodiment, the zero-cross signal request cancel period is set to be a period from the output of the heater control signal by the controller 604 and within the set time period T. However, the zero-cross request cancel period may be set to be a period within the set period T from the timing of actually switching ON/OFF of the switching device 605 after the reception of the heater control signal by the heater driving circuit 601. In this case, the set time period T may be determined with use of a measurement time which is obtained by measuring a time period from the output of the heater control signal from the controller 604 and the reception of the heater control signal by the heater driving circuit 601 to the switching of ON/OFF of the switching device 605. Or, an alarm signal (dotted line in FIG. 2) may be outputted from the heater driving circuit 601 concurrently at the time when ON/OFF of the switching device 605 is switched, and the controller 604 may start the zero-cross request cancel period in accordance with the alarm signal as a trigger.

In summary, in accordance with an aspect of the present invention, a heating device includes: a heater which is driven by a power supplied from an AC power source; a switching portion which switches ON/OFF of the power supplied from the AC power source to the heater; a zero-cross signal output portion which outputs a zero-cross signal in response to a zero-cross point of an AC voltage outputted from the AC power source; and a controller which controls the switching portion to switch ON/OFF in response to the zero-cross signal, and the controller disregards the zero-cross signal outputted within a predetermined time period after controlling the switching portion to switch ON/OFF and prevents the switching portion from switching ON/OFF in response to the zero-cross signal.

Further, according to another aspect of the present invention, an image forming apparatus includes: an image forming section which forms an image on a recording medium; a heater which is driven by a power supplied from an AC power source; a fixing section which includes a heat roller, which uses a heat supplied from the heater to heat the recording medium on which the image formed by the image forming section, and a pressure roller which is pressed against the heat roller, the fixing section fixing toner on the recording medium to the recording medium by sandwiching the recording sheet between the heat roller and the pressure roller; a switching portion which switches ON/OFF the power supplied from the AC power source to the heater; a zero-cross signal output portion which outputs a zero-cross signal in response to a zero-cross point of an AC voltage outputted from the AC power source; and a controller which controls the switching portion to switch ON/OFF in response to the zero-cross signal, the controller disregarding the zero-cross signal outputted within a predetermined time period after controlling the switching portion to switch ON/OFF and prevents the switching portion from switching ON/OFF in response to the zero-cross signal.

According to the invention, a zero-cross signal outputted within a predetermined time period from switching of ON/OFF by the switching portion is disregarded. Accordingly, regardless of whether the drive control of the heater is a phase control, a zero-cross signal which occurs due to a noise which occurs due to switching of ON/OFF of the switching device can be reliably disregarded. Accordingly, malfunction in the heater can be prevented.

For example, (a) the conventional technology of Japanese Patent No. 3636254 as mentioned in the section of Description of the Background Art cannot disregard the false detection of the zero-cross point due to a noise in the case where the temperature control of the heater is performed without the phase control. (b) In the cases of technologies disclosed in Japanese Unexamined Patent Publication No. 2002-272089, Japanese Examined Patent Application Publication No. 5-87844, Japanese Examined Patent Application Publication No. 7-72849, and Japanese Unexamined Patent Publication No. 4-165954 as mentioned in the section of Description of the Background Art, if a processing of determining a duty value once a predetermined times of the zero-cross interruption or a processing of multiple interruption occurs, the time period from the zero-cross interruption to ON/OFF of the heater varies, thus occurrence of ON/OFF of the heater within the zero-cross interruption disregard period is not assured. Especially in the case of using the phase control, there is likelihood that the zero-cross interruption due to a noise of ON/OFF of the heater does not fall in the zero-cross interruption disregard period. However, according to the present invention, the problems (a) and (b) mentioned above can be resolved.

(c) Further, a method of setting the zero-cross interruption disregard period as a zero-cross interval. However, since there are various cases in commercial power source frequencies, e.g. 50 kHz and 60 kHz, in the interval of occurrence of the zero-cross interruption, an appropriate value shall be used to make the zero-cross interruption disregard period be effective for both. For example, if the interval of occurrence of the zero-cross interruption is 10 ms in 50 kHz and 8.3 ms in 60 kHz, the shorter interval of 8.3 ms can be set as the zero-cross interruption disregard period. However, although it is effective for preventing malfunction due to chattering, there is likelihood that the zero-cross interruption due to a noise which occurs due to ON/OFF of the heater in the case of using the phase control does not fall in the zero-cross interruption disregard period. On the other hand, according to the present invention, the problem (c) can be resolved, and the zero-cross interruption due to a noise can fall in the zero-cross interruption disregard period reliably.

Further, according to an aspect of the present invention, the controller outputs a control signal, which controls the switching portion to switch ON/OFF to the switching portion in response to the zero-cross signal and disregards the zero-cross signal outputted within the predetermined time period after outputting the control signal, and the switching portion switches ON/OFF in response to the control signal.

According to this aspect of the invention, the controller disregards the zero-cross signal outputted within a predetermined time period after the output of the control signal, so that the zero-cross signal which occurs due to a noise which occurs due to switching of ON/OFF by the switching device can be disregarded reliably. Accordingly, malfunction in the heater can be prevented.

Further, according to an aspect of the present invention, the controller outputs a control signal, which controls the switching portion to switch ON/OFF, to the switching portion in response to the zero-cross signal and disregards also the zero-cross signal outputted within a pre-measured time period from the outputting of the control signal to the switching of ON/OFF by the switching portion in response to the control signal, and the switching portion switches ON/OFF in response to the control signal.

According to this invention, the controller disregards the zero-cross signal outputted within a pre-measured time period taken between the outputting of the control signal and the switching of ON/OFF performed by the switching portion in response to the control signal. Accordingly, a zero-cross signal which occurs due to a noise which occurs due to switching of ON/OFF by the switching device can be disregarded reliably, thus a malfunction in the heater can be prevented.

Further, according to an aspect of the present invention, the switching portion outputs an alarm signal at the time of switching ON/OFF in response to the control signal, and the controller disregards the zero-cross signal outputted within the predetermined time period after accepting the alarm signal.

According to this invention, the controller disregards the zero-cross signal outputted within the predetermined period after receiving an alarm signal indicating switching of ON/OFF by the switching portion. Accordingly, a zero-cross signal which occurs due to a noise which occurs due to switching of ON/OFF by the switching device.

This application is based on Japanese Patent application serial No. 2008-043802 filed in Japan Patent Office on Feb. 26, 2008, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

What is claimed is:

1. A heating device comprising:

a heater which is driven by a power supplied from an AC power source;

a switching portion which switches ON/OFF of the power supplied from the AC power source to the heater;

a zero-cross signal output portion which outputs a zero-cross signal in response to a zero-cross point of an AC voltage outputted from the AC power source; and a controller which sends out a control signal to the switching portion to switch ON/OFF in response to the zero-cross signal in order to execute a switching control of the switching portion, wherein said controller is shiftable between a zero-cross interruption request state where the controller accepts execution of an interruption processing in accordance with an input of the zero-cross signal and a zero-cross interruption request cancel state where the controller does not accept an input of the zero-cross signal, the controller shifts to said zero-cross interruption request cancel state in order to disregard the zero-cross signal outputted and refrain from sending the control signal in response to the zero-cross signal to the switching portion during a predetermined time period after controlling the switching portion to switch ON/OFF, the controller shifts back to said zero-cross interruption request state after passage of said predetermined time period after controlling the switching portion to switch ON/OFF, and said predetermined time period is longer than a time period from when the switching portion switches ON/OFF until when the zero-cross signal is outputted caused by the switching operation of the switching portion.

2. The heating device according to claim 1, wherein the controller outputs the control signal, which controls the switching portion to switch ON/OFF, to the switching portion in response to the zero-cross signal and disregards the zero-cross signal outputted within the predetermined time period after outputting the control signal, and the switching portion switches ON/OFF in response to the control signal.

3. The heating device according to claim 1, wherein the controller outputs the control signal, which controls the switching portion to switch ON/OFF, to the switching portion in response to the zero-cross signal and disregards also the zero-cross signal outputted during the predetermined time period from the outputting of the control signal to the switching of ON/OFF by the switching portion in response to the control signal, and the switching portion switches ON/OFF in response to the control signal.

4. The heating device according to claim 1, wherein the switching portion outputs an alarm signal at the time of switching ON/OFF in response to the control signal, and the controller disregards the zero-cross signal outputted within the predetermined time period after accepting the alarm signal.

5. An image forming apparatus comprising:

an image forming section which forms an image on a recording medium;

a heater which is driven by a power supplied from an AC power source;

a fixing section which includes a heat roller, which uses a heat supplied from the heater to heat the recording medium on which the image is formed by the image forming section, and a pressure roller which is pressed against the heat roller, the fixing section fixing toner on the recording medium to the recording medium by sandwiching the recording sheet between the heat roller and the pressure roller;

a switching portion which switches ON/OFF the power supplied from the AC power source to the heater;

a zero-cross signal output portion which outputs a zero-cross signal in response to a zero-cross point of an AC voltage outputted from the AC power source; and a controller which sends out a control signal to the switching portion to switch ON/OFF in response to the zero-cross signal in order to execute a switching control of the switching portion, wherein said controller is shiftable between a zero-cross interruption request state where the controller accepts execution of an interruption processing in accordance with an input of the zero-cross signal and a zero-cross cancel request state where the controller does not accept an input of the zero-cross signal, the controller shifts to said zero-cross interruption request cancel state in order to disregard the zero-cross signal outputted and refrain from sending the control signal in response to the zero-cross signal to the switching portion during a predetermined time period after controlling the switching portion to switch ON/OFF, the controller shifts back to said zero-cross interruption request state after passage of said predetermined time period after controlling the switching portion to switch ON/OFF, and said predetermined time period is longer than a time period from when the switching portion switches ON/OFF until when the zero-cross signal is outputted caused by the switching operation of the switching portion.

6. The image forming apparatus according to claim 5, wherein the controller outputs the control signal, which controls the switching portion to switch ON/OFF, to the switching portion in response to the zero-cross signal and disregards the zero-cross signal outputted within the predetermined time period after outputting the control signal, and the switching portion switches ON/OFF in response to the control signal.

7. The image forming apparatus according to claim 5, wherein the controller outputs the control signal, which controls the switching portion to switch ON/OFF, to the switching portion in response to the zero-cross signal and disregards also the zero-cross signal outputted during the predetermined time period from the outputting of the control signal to the switching of ON/OFF by the switching portion in response to the control signal, and the switching portion switches ON/OFF in response to the control signal.

8. The image forming apparatus according to claim 5, wherein the switching portion outputs an alarm signal at the time of switching ON/OFF in response to the control signal, and the controller disregards the zero-cross signal outputted within the predetermined time period after accepting the alarm signal.

* * * * *